US011168510B2

(12) United States Patent
Albrecht

(10) Patent No.: US 11,168,510 B2
(45) Date of Patent: Nov. 9, 2021

(54) WINDOW ASSEMBLY

(71) Applicant: Sierra Pacific Industries, Anderson, CA (US)

(72) Inventor: Scott D. Albrecht, Merrill, WI (US)

(73) Assignee: Sierra Pacific Industries, Anderson, CA (US)

( * ) Notice: Subject to any disclaimer, the term of this patent is extended or adjusted under 35 U.S.C. 154(b) by 0 days.

(21) Appl. No.: 16/409,246

(22) Filed: May 10, 2019

(65) Prior Publication Data

US 2019/0352958 A1 Nov. 21, 2019

Related U.S. Application Data

(60) Provisional application No. 62/672,306, filed on May 16, 2018.

(51) Int. Cl.

| | |
|---|---|
| ***E06B 1/70*** | (2006.01) |
| ***E06B 1/36*** | (2006.01) |
| ***E06B 1/32*** | (2006.01) |

(52) U.S. Cl.

CPC ..... *E06B 1/705* (2013.01); *E06B 1/32* (2013.01); *E06B 1/36* (2013.01)

(58) Field of Classification Search

CPC ... E06B 1/705; E06B 1/36; E06B 1/32; E06B 7/14; E06B 3/4415; E06B 1/02; E06B 1/70

See application file for complete search history.

(56) References Cited

U.S. PATENT DOCUMENTS

| | | | | |
|---|---|---|---|---|
| 3,784,043 | A * | 1/1974 | Presnick | B65D 88/528 220/4.28 |
| 4,164,105 | A * | 8/1979 | Herbst | E06B 3/28 160/394 |
| 4,314,424 | A * | 2/1982 | Gordon | E06B 7/2312 49/400 |
| 5,136,814 | A * | 8/1992 | Headrick | E06B 1/70 49/468 |
| D411,018 | S * | 6/1999 | Nowell | D25/61 |
| 7,614,188 | B2 * | 11/2009 | Hetherington | E06B 3/9641 52/204.58 |
| D734,136 | S * | 7/2015 | Therrien | D8/382 |
| 9,238,934 | B2 * | 1/2016 | Booi | E06B 1/342 |
| 9,827,522 | B2 * | 11/2017 | Simmons | E06B 9/52 |
| 2005/0115178 | A1 * | 6/2005 | Schmidt | E06B 3/9641 52/272 |
| 2008/0034702 | A1 * | 2/2008 | Garries | E06B 3/9641 52/656.2 |

FOREIGN PATENT DOCUMENTS

| | | | | |
|---|---|---|---|---|
| WO | WO-0204778 A1 * | 1/2002 | | E06B 1/70 |
| WO | WO-2010077236 A1 * | 7/2010 | | E06B 3/9632 |

* cited by examiner

*Primary Examiner* — Jessie T Fonseca
(74) *Attorney, Agent, or Firm* — Merchant & Gould P.C.

(57) ABSTRACT

Window assemblies and methods for their construction are disclosed. In one aspect, the disclosed window assemblies include wooden side jambs connected to a non-wooden sill assembly via intermediately positioned end caps. In some examples, each end cap includes a main body and a step defined within the main body for supporting an end of the sill assembly, wherein the step extends at an oblique angle to a length of the side jamb associated with the end cap. The provision of an angled or obliquely oriented shelf eliminates the need to mill a similarly shaped structure within the wooden side jambs.

15 Claims, 17 Drawing Sheets

FIG. 15
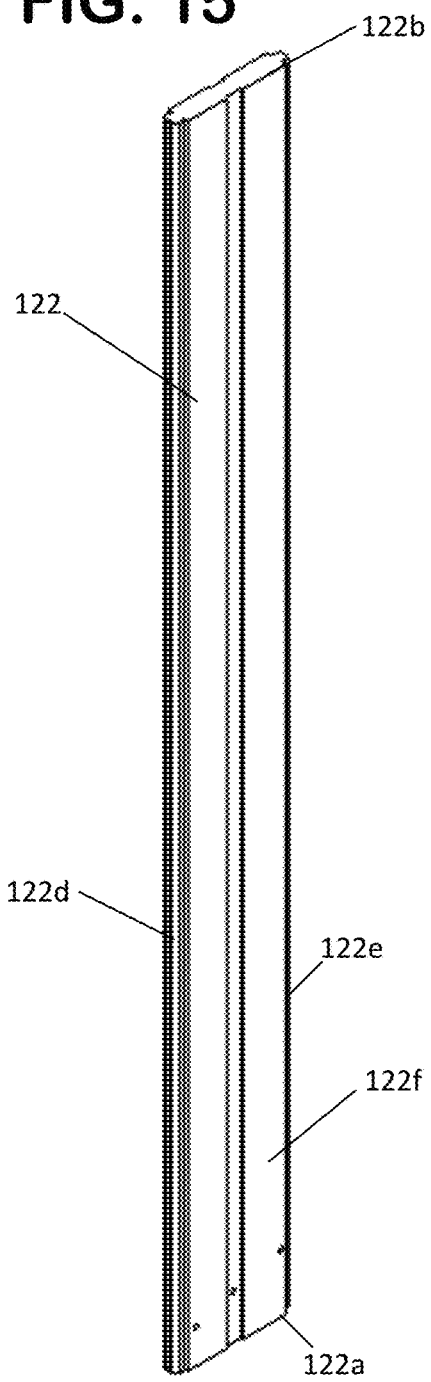
FIG. 16
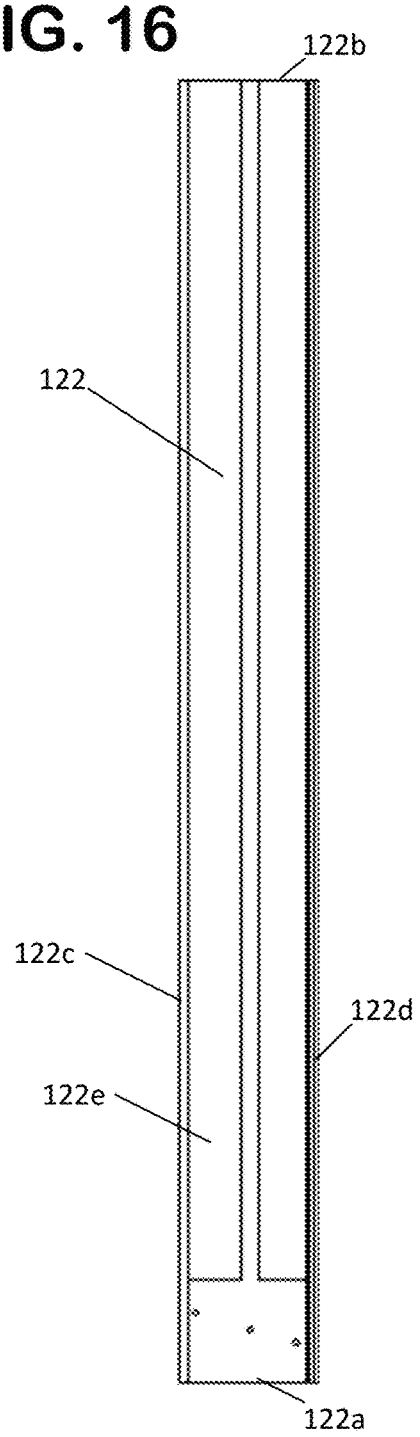
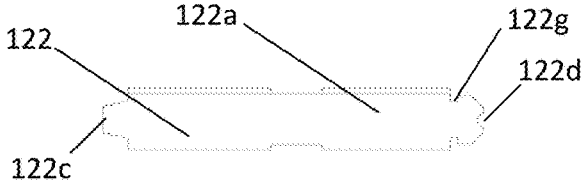
FIG. 17

WINDOW ASSEMBLY

This application claims priority to U.S. Provisional Patent Application Ser. No. 62/672,306, filed on May 16, 2018, the entirety of which is incorporated by reference herein.

TECHNICAL FIELD

This disclosure relates generally to window assemblies, and methods of constructing window assemblies.

BACKGROUND

Many materials have been utilized to construct window assemblies, such as wood, polyvinyl chloride (PVC), fiberglass and aluminum. Each of these materials has various advantages and disadvantages with respect to the other, such as cost, durability, aesthetics and the ability to prevent air and moisture infiltration. Frequently, the structural and trim pieces of a window assembly are constructed of the same type of material. However, it is sometimes the case that a window assembly will be constructed by using two or more different materials. For example, interior wood frame and trim pieces have been used in conjunction with window assembly having vinyl components to improve the interior aesthetics of the window assembly. Another example is where aluminum or vinyl exterior cladding has been added to a wooden window assembly in order to improve the durability of the window assembly without sacrificing interior aesthetics. Improvements in window assemblies which utilize more than one material are desired.

SUMMARY

A window assembly, including a system for connecting the components of the window assembly is disclosed.

In some examples, a window assembly is disclosed that includes a pair of side jambs extending between first and second ends, a sill assembly extending between the pair of side jambs proximate the first ends, a head jamb extending between the pair of side jambs proximate the second ends, and a pair of oppositely facing end caps operably connecting the pair of side jambs to the sill assembly.

In some examples, each of the pair of end caps includes a main body and a step defined within the main body for supporting an end of the sill assembly, wherein the step extends at an oblique angle to a length of the side jamb associated with the end cap.

In some examples, each of the pair of end caps is unitarily formed.

In some examples, the pair of side jambs are formed from a wood material.

In some examples, the pair of end caps are formed from a polymeric material.

In some examples, the window assembly further includes a pair of gaskets, wherein each of the pair of gaskets is located between one of the pair of side jambs and the end cap associated with the side jamb.

In some examples, the sill assembly includes a base member formed from a PVC material.

In some examples, the end caps, side jambs, and the sill assembly are secured together by a plurality of fasteners.

In some examples, the main body of each of the pair of end caps includes a plurality of pre-formed holes through which the plurality of fasteners extend.

In some examples, the sill assembly includes pre-formed holes for receiving the plurality of fasteners.

In some examples, an end cap for forming a joint structure in a window assembly is disclosed that includes a unitarily formed main body, a flange structure defined on a first side of the main body, the flange structure being adapted for supporting a side jamb of the window assembly, and a step surface defined on a second side of the main body, the step surface being adapted for supporting an end of a sill assembly of the window assembly, the step surface extending at an oblique angle to a side edge of the main body.

In some examples, the end cap includes a plurality of holes extending through the main body, the plurality of holes being aligned in a parallel relationship to the step surface.

In some examples, the end cap further includes a nail fin flange.

In some examples, the flange structure is L-shaped and includes a first flange surface and a second flange surface extending orthogonally from the first flange surface.

In some examples, the end cap main body is formed from a PVC material.

In some examples, a joint structure of a window assembly is disclosed that includes a side jamb, a sill assembly arranged in an orthogonal relationship with the side jamb, and an end cap joining the side jamb to the sill assembly. The end cap can include a main body and a step defined within the main body and supporting an end of the sill assembly, the step extending at an oblique angle to a length of the side jamb.

In some examples, the end cap is unitarily formed.

In some examples, the side jamb is formed from a wood material, the sill assembly includes a base member formed from a PVC material, and the end cap is formed from a PVC material.

In some examples, the joint structure further includes a gasket located between the side jamb and the end cap.

In some examples, the end cap, side jamb, and the sill assembly are secured together by a plurality of fasteners.

In some examples, the sill assembly includes pre-formed holes for receiving the plurality of fasteners.

A variety of additional aspects will be set forth in the description that follows. The aspects can relate to individual features and to combinations of features. It is to be understood that both the forgoing general description and the following detailed description are exemplary and explanatory only and are not restrictive of the broad inventive concepts upon which the examples disclosed herein are based.

BRIEF DESCRIPTION OF THE DRAWINGS

FIG. 15 is a first perspective view of a side jamb member of the window assembly shown in FIG. 1.

FIG. 16 is a side view of the side jamb member shown in FIG. 15.

FIG. 17 is an end view of the side jamb member shown in FIG. 15.

DETAILED DESCRIPTION

Figure 1:
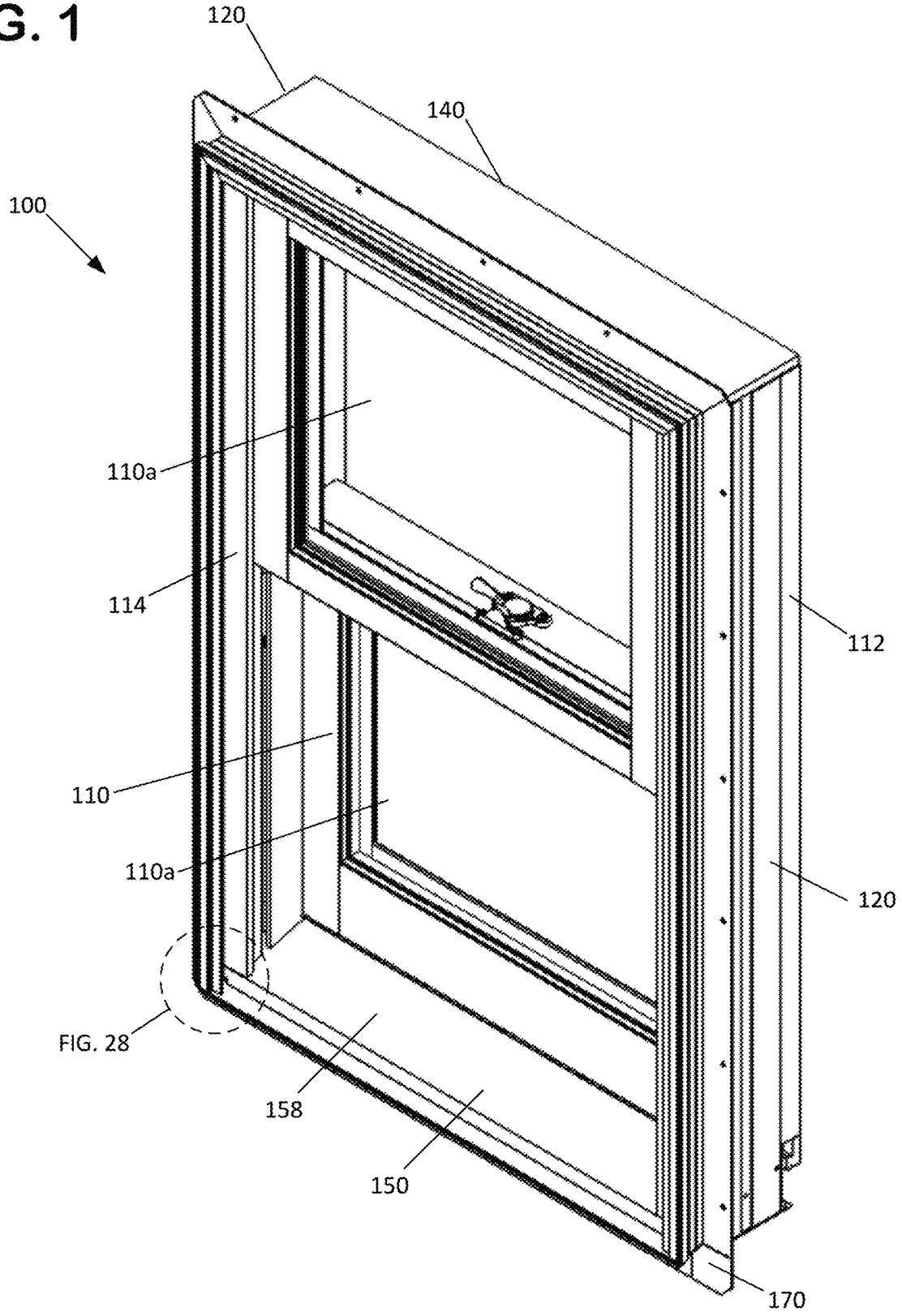
FIG. 1 is a perspective view from the exterior side of a window assembly in accordance with principles and concepts presented herein.

Various examples will be described in detail with reference to the drawings, wherein like reference numerals represent like parts and assemblies throughout the several views. Reference to various examples does not limit the scope of the claims attached hereto. Additionally, any examples set forth in this specification are not intended to be limiting and merely set forth some of the many possible examples for the appended claims. Referring to the drawings wherein like reference numbers correspond to like or similar components throughout the several figures.

Reference will now be made in detail to exemplary aspects of the present disclosure that are illustrated in the accompanying drawings. Wherever possible, the same reference numbers will be used throughout the drawings to refer to the same or like parts.

Figure 2:
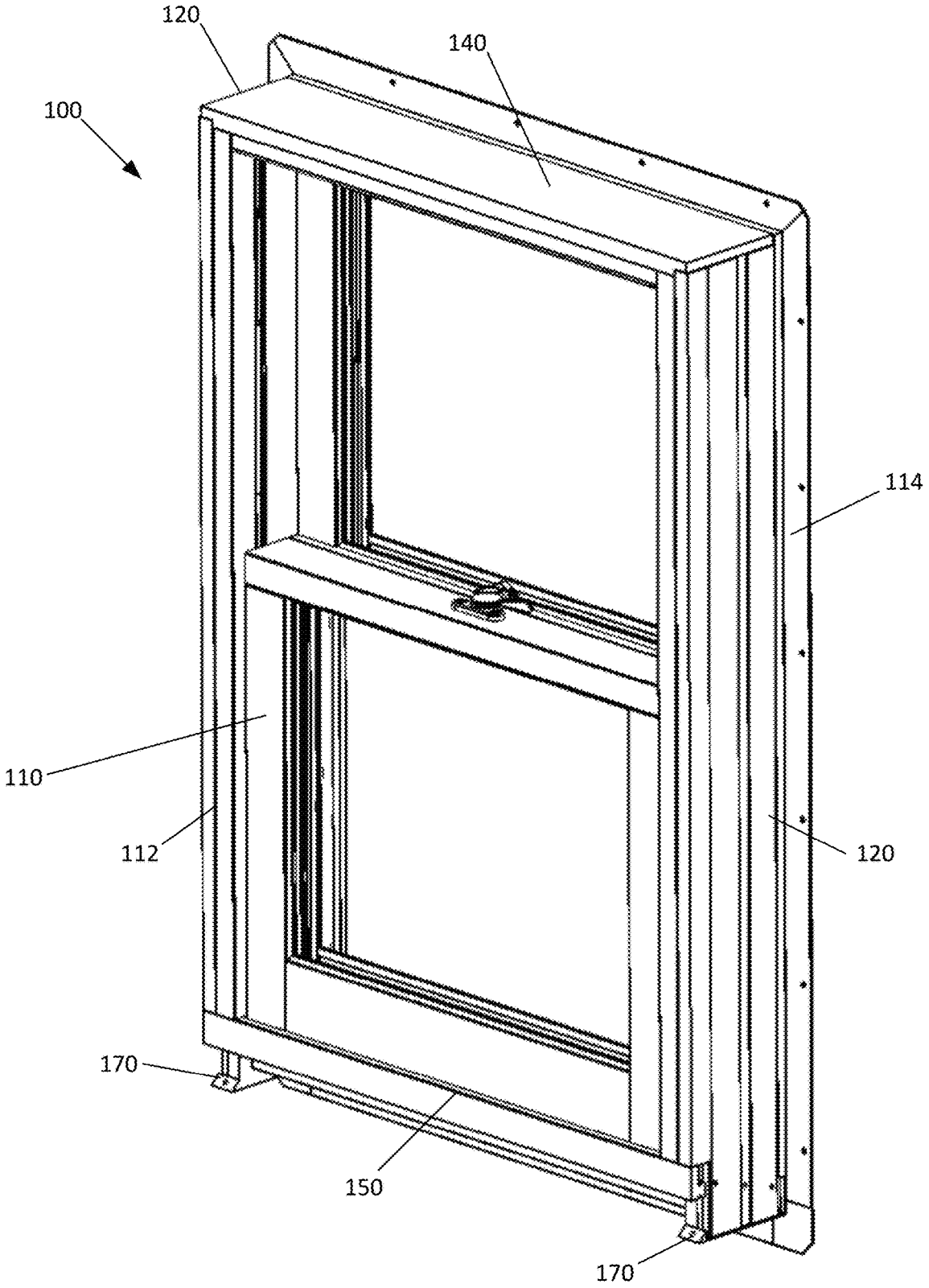
FIG. 2 is an interior side perspective view of the window assembly shown in FIG. 1.
Figure 3:
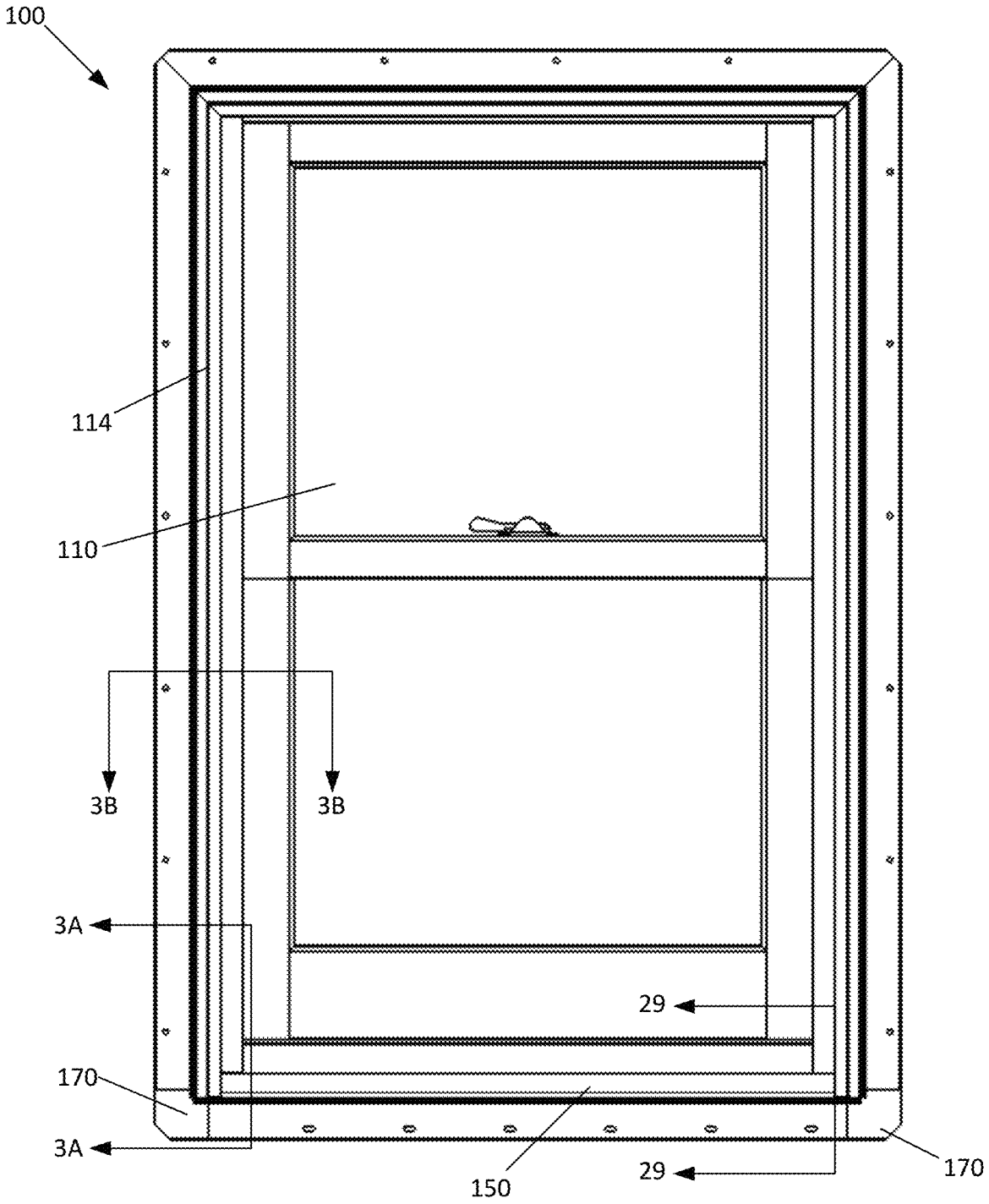
FIG. 3 is an exterior side elevation view of the window assembly shown in FIG. 1.
Figure 3A:
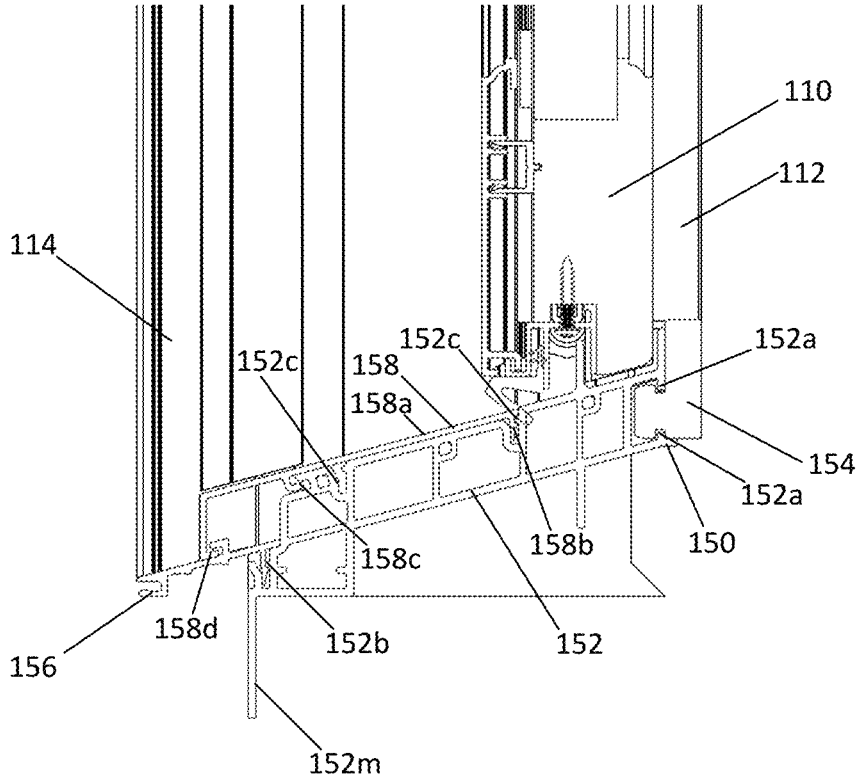
FIG. 3A is a partial cross-sectional view of the window assembly shown in FIG. 1, taken along the line 2A-2A in FIG. 2.
Figure 3B:
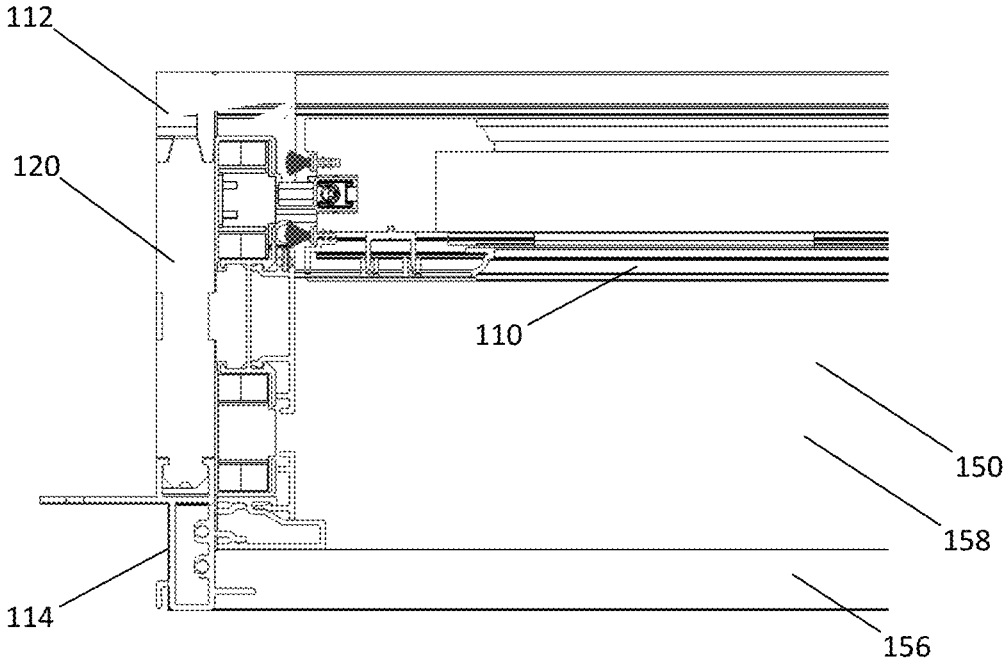
FIG. 3B is a partial cross-sectional view of the window assembly shown in FIG. 1, taken along the line 2B-2B in FIG. 2.
Figure 4:
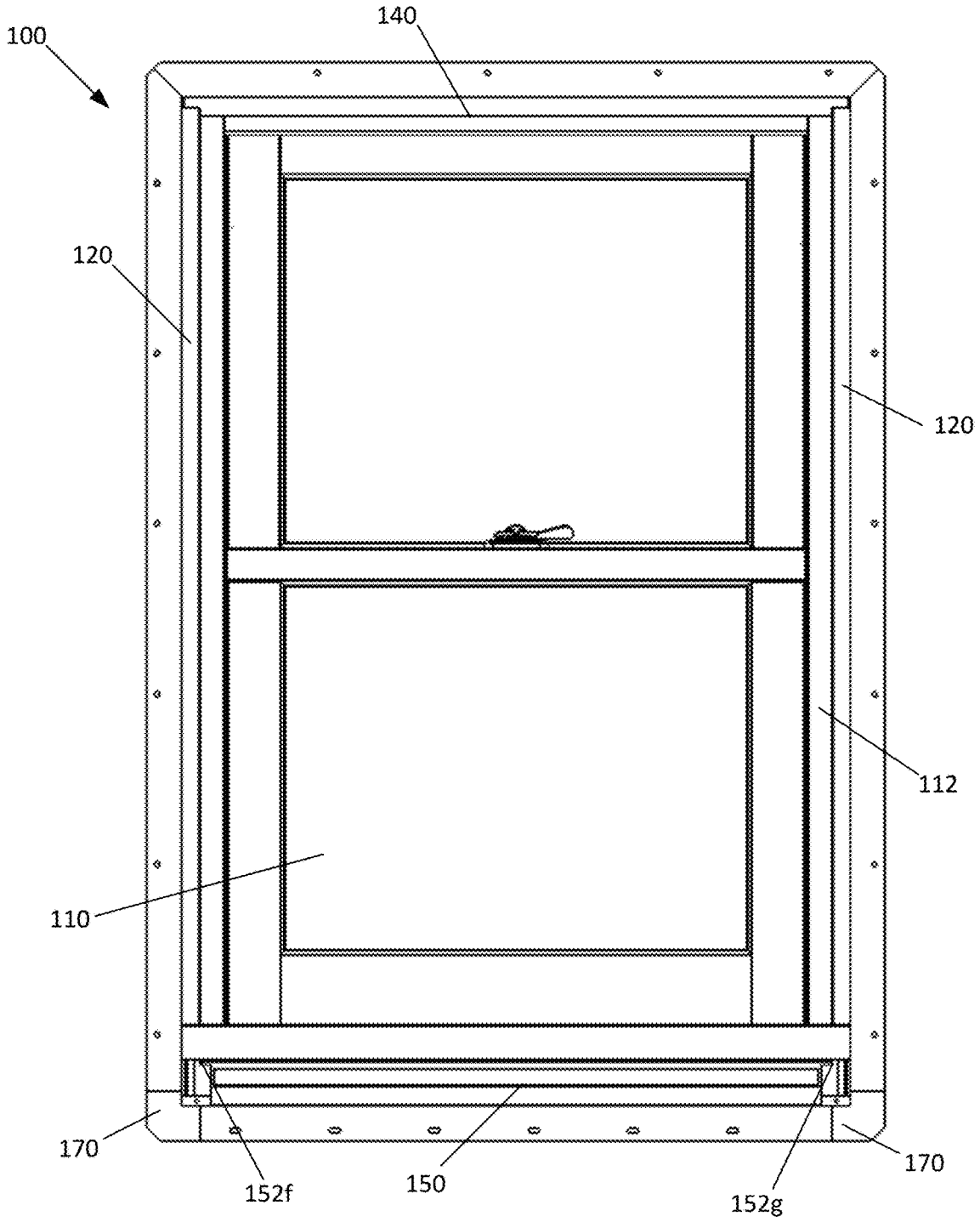
FIG. 4 is an interior side elevation view of the window assembly shown in FIG. 1.
Figure 5:
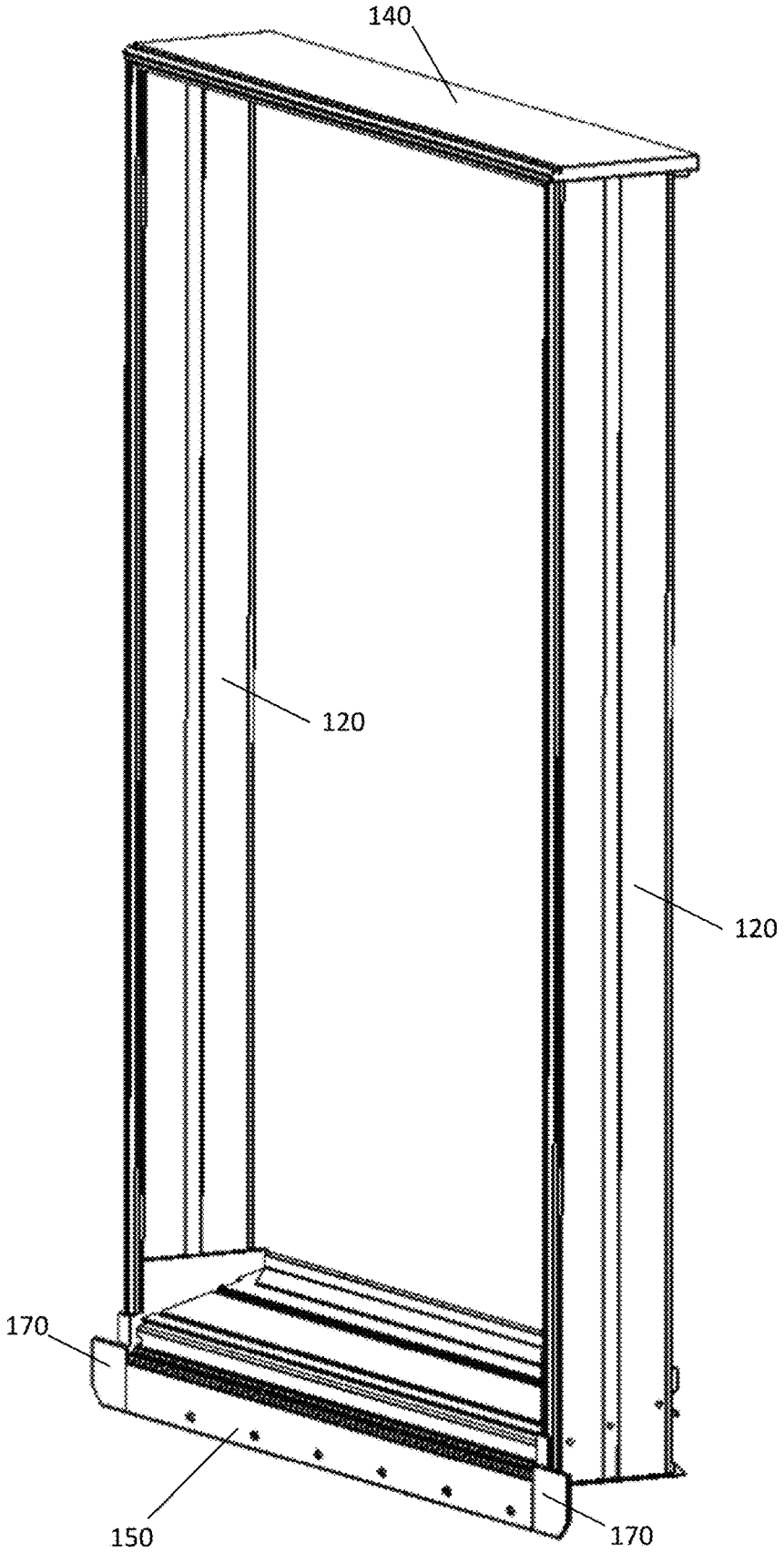
FIG. 5 is a perspective view of a subassembly of the window assembly shown in FIG. 1.
Figure 6:
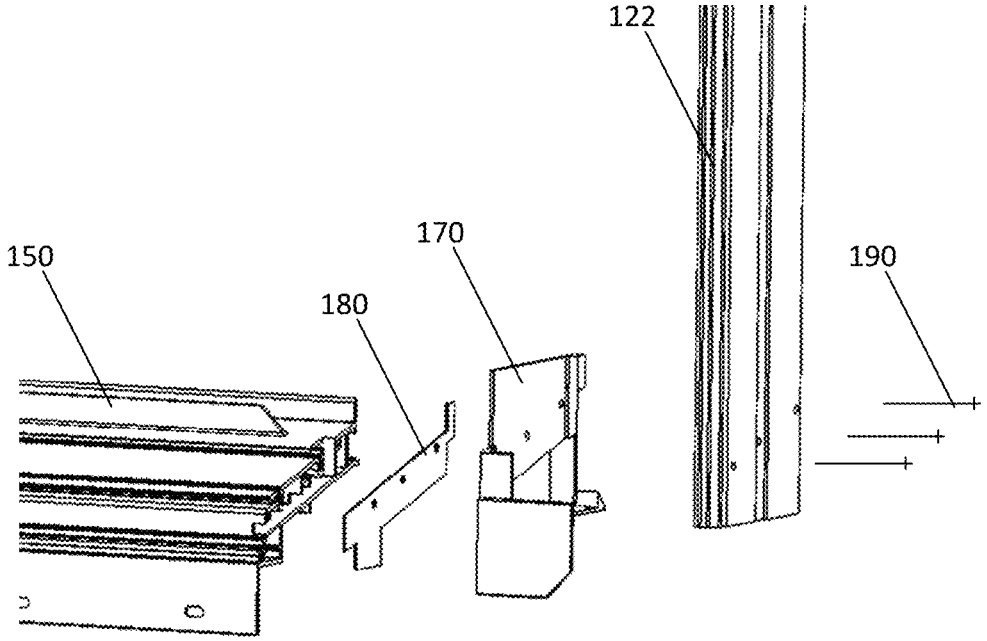
FIG. 6 is a partial top perspective exploded view of a sill assembly of the window assembly shown in FIG. 1, in addition to a gasket, end cap, and side jamb of the window assembly.
Figure 7:
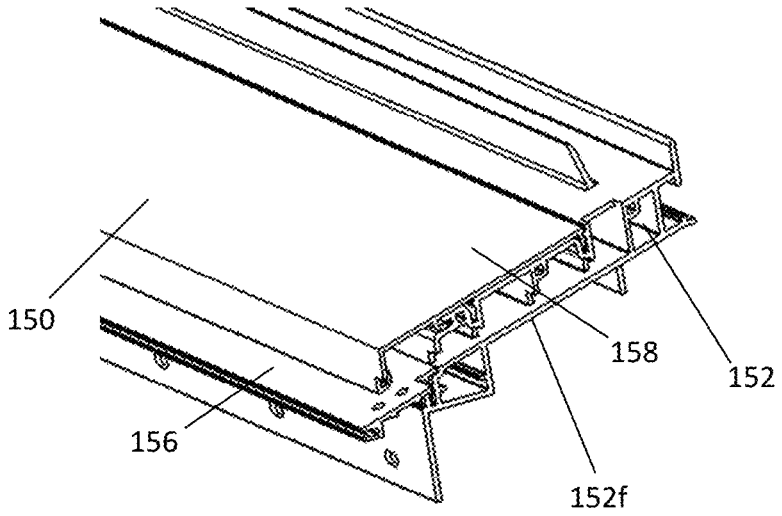
FIG. 7 is a partial top perspective view of a sill assembly of the window assembly shown in FIG. 1.
Figure 8:
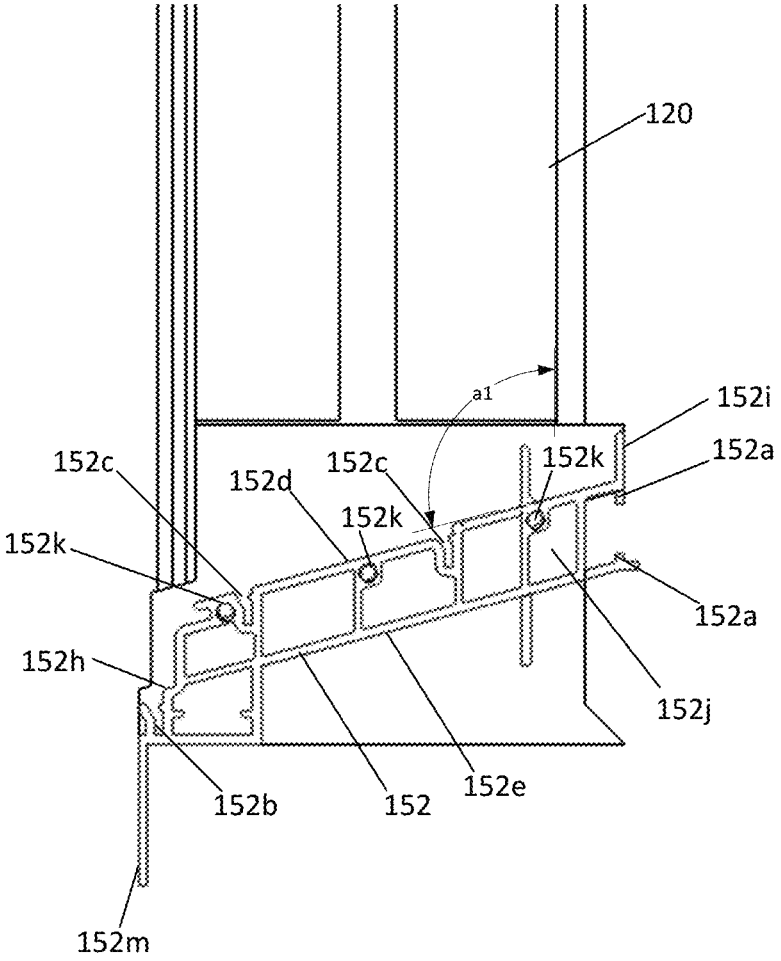
FIG. 8 is a partial cross-sectional view of the subassembly shown in FIG. 6.
Figure 9:
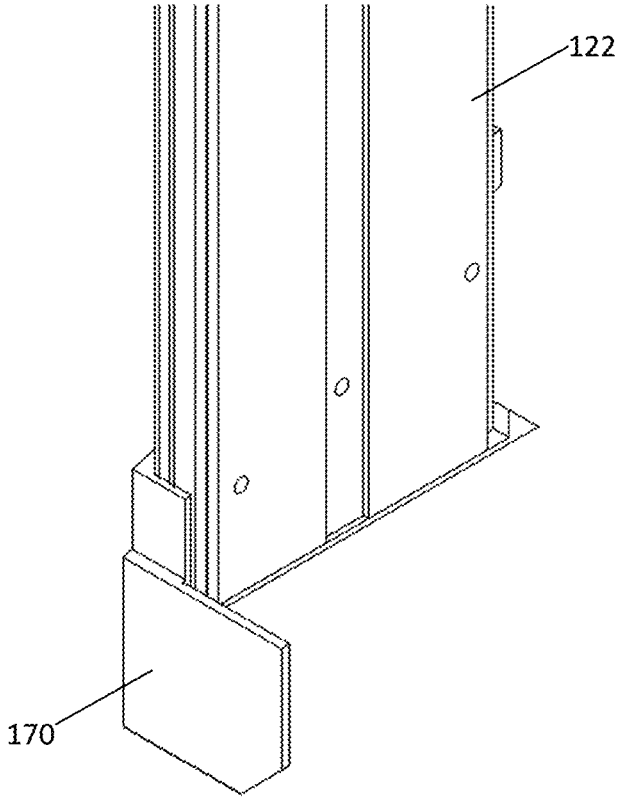
FIG. 9 is a first perspective view of a subassembly of the window assembly shown in FIG. 1.
Figure 10:
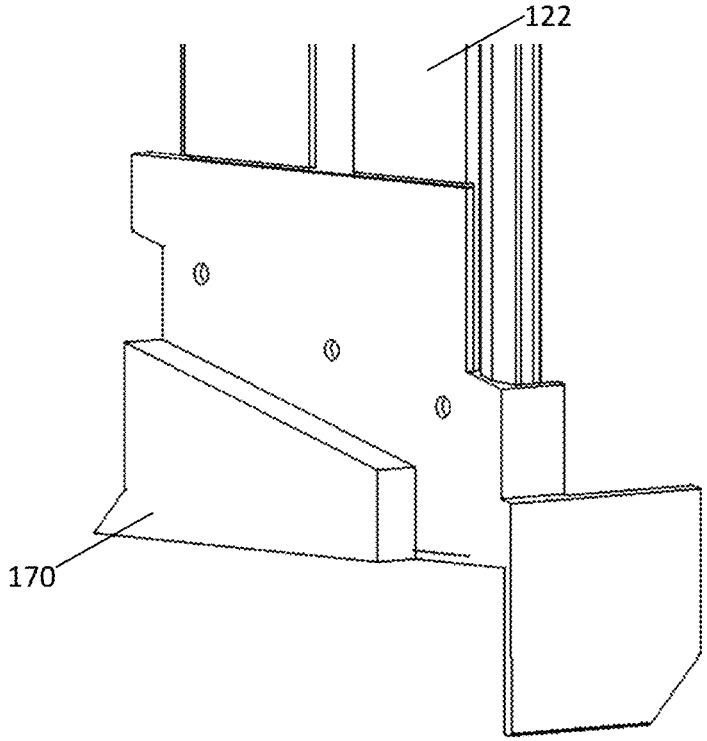
FIG. 10 is a second perspective view of the subassembly shown in FIG. 9.
Figure 11:
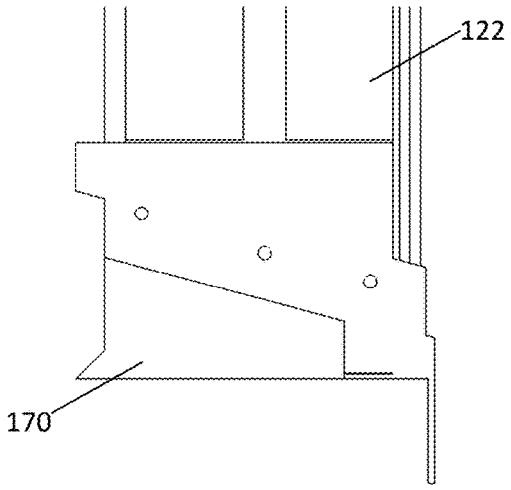
FIG. 11 is a first side view of the subassembly shown in FIG. 9.
Figure 12:
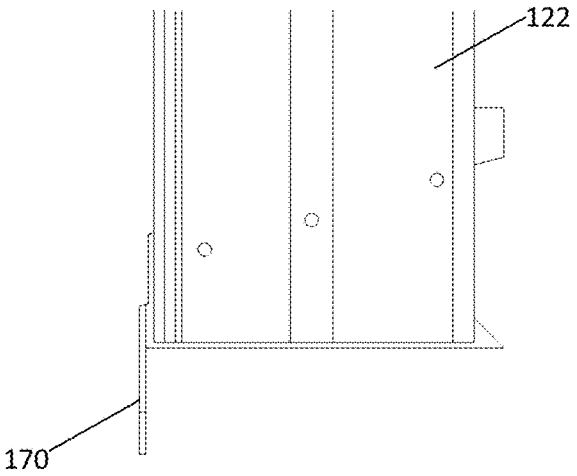
FIG. 12 is a second side view of the subassembly shown in FIG. 9.
Figure 13:
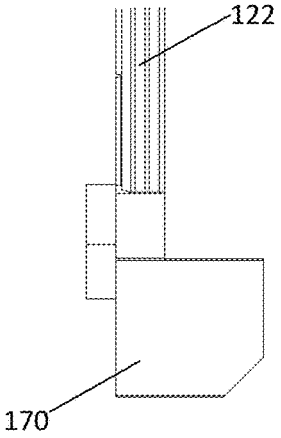
FIG. 13 is a first end view of the subassembly shown in FIG. 9.
Figure 14:
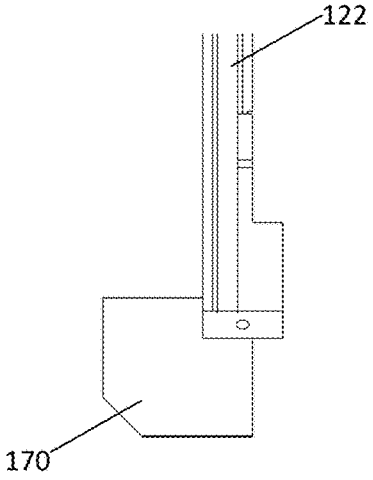
FIG. 14 is a second end view of the subassembly shown in FIG. 9.
Figure 18:
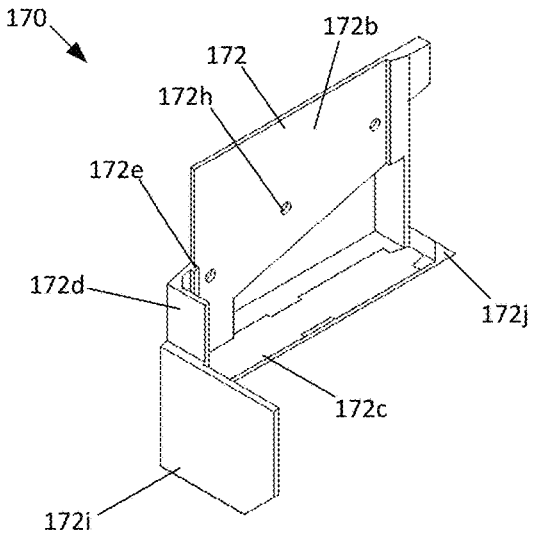
FIG. 18 is a first perspective view of an end cap of the window assembly shown in FIG. 1.
Figure 19:
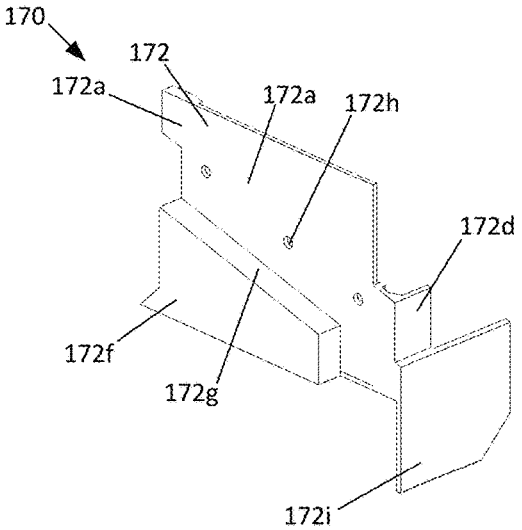
FIG. 19 is a second perspective view of the end cap shown in FIG. 18.
Figure 20:
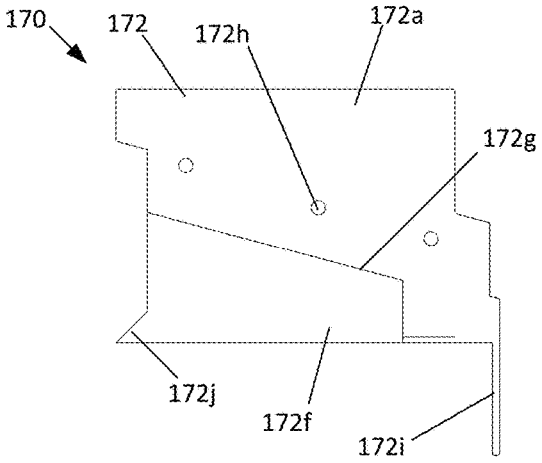
FIG. 20 is a first side view of the end cap shown in FIG. 18.
Figure 21:
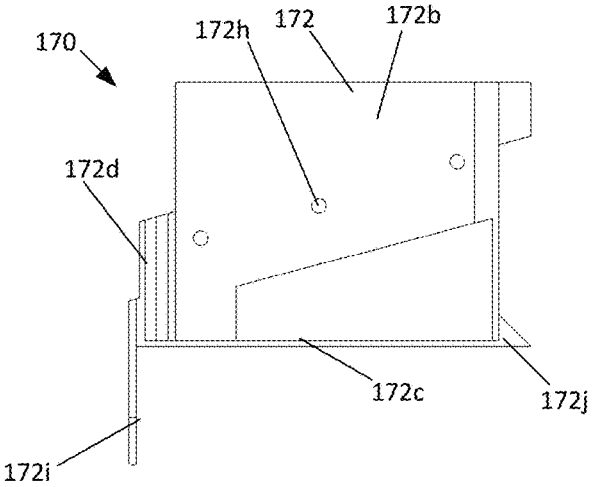
FIG. 21 is a second side view of the end cap shown in FIG. 18.
Figure 22:
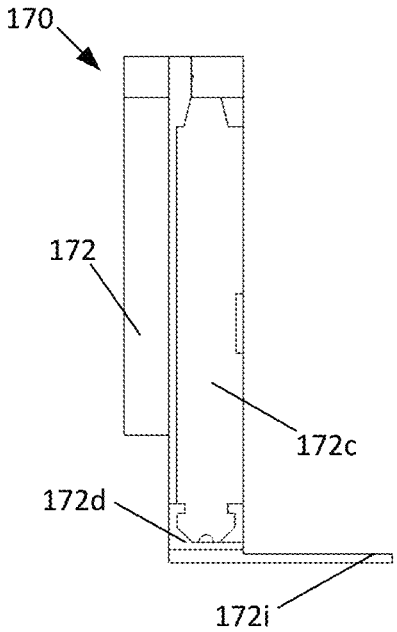
FIG. 22 is a top view of the end cap shown in FIG. 18.
Figure 23:
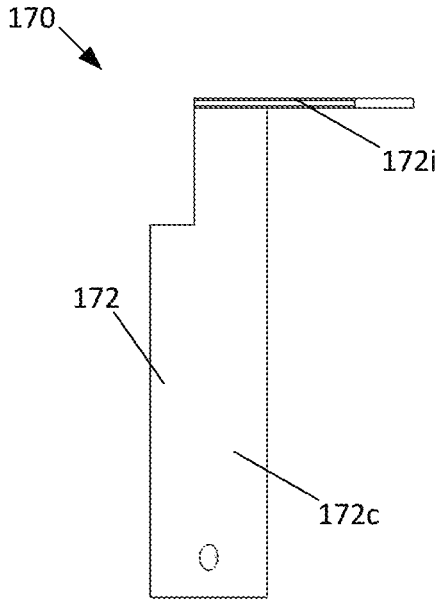
FIG. 23 is a bottom view of the end cap shown in FIG. 18.
Figure 24:
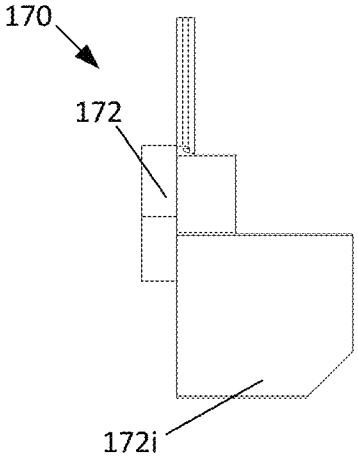
FIG. 24 is a front view of the end cap shown in FIG. 18.
Figure 25:
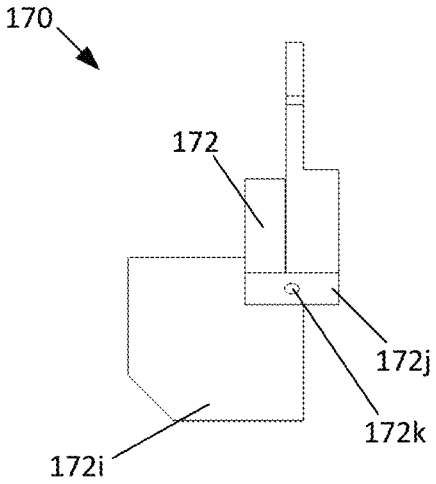
FIG. 25 is a rear view of the end cap shown in FIG. 18.

Referring to FIGS. 1 to 3, an exemplary embodiment of a window assembly 100 is shown. The window assembly 100 depicted is a double hung style window and is only presented to illustrate the general components of window assemblies in generalized manner. Even though specific depictions of other styles of fully assembled window assemblies are not presented herein, one having ordinary skill in the art will readily understand from the cross-sectional views and descriptions presented herein how to form a fully formed window assembly of any style. For example, window assembly 100 can be constructed as a horizontal sliding window, a casement window, single or double hung windows, fixed windows, awning windows, and other types of windows and doors.

As shown, the window assembly 100 includes a sash assembly 110 retained by a pair of side jambs 122 of a side jamb assembly 120 extending between a header 140 and a sill assembly 150. The sill assembly 150 is supported by a pair of end caps 170 that adjoin the side jambs 122. An exemplary side jamb 122 is shown in isolation at FIGS. 15 to 17 while an exemplary end cap 170 is shown in isolation at FIGS. 18 to 25. An interior trim assembly 112 is also provided on the interior side of the window assembly 100. The interior trim assembly 112 includes members that attach to the side jambs 122 (e.g. via fasteners 190 or an adhesive such as glue in a tongue and groove arrangement), the header 140, and to an interior trim member 154 of the sill assembly 150. In one aspect, the interior trim member 154 forms a fourth side of the interior trim assembly 112, and can therefore be said to be a component of the interior trim assembly 112. An exterior cladding assembly 114 is also provided on the exterior side of the window assembly. The exterior cladding assembly 114 includes members that attach to the side jambs 122 (e.g. via a snap-fit connection), and the header 140 and to an exterior cladding member 156 of the sill assembly 150. In one aspect, the exterior cladding member 156 forms a fourth side of the exterior cladding assembly 114, and can therefore be said to be a component of the exterior cladding assembly 114. The general construction of the sash assembly 110, the interior trim assembly 112, the exterior cladding assembly 114, and the header 140 are well understood by those in the art and need not be discussed further herein.

Figure 26:
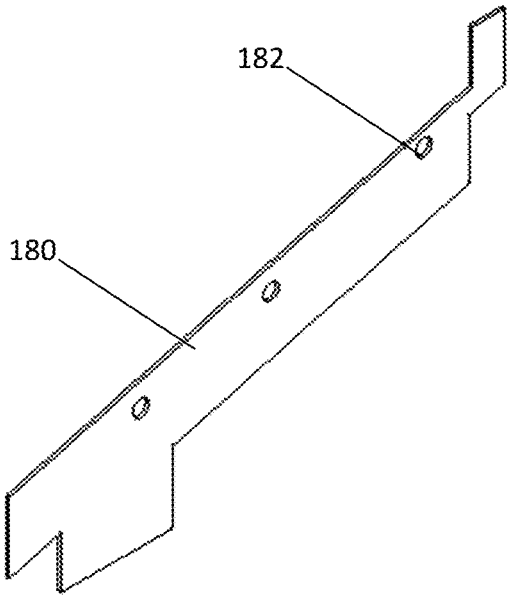
FIG. 26 is a perspective view of a gasket member of the window assembly shown in FIG. 1.
Figure 27:
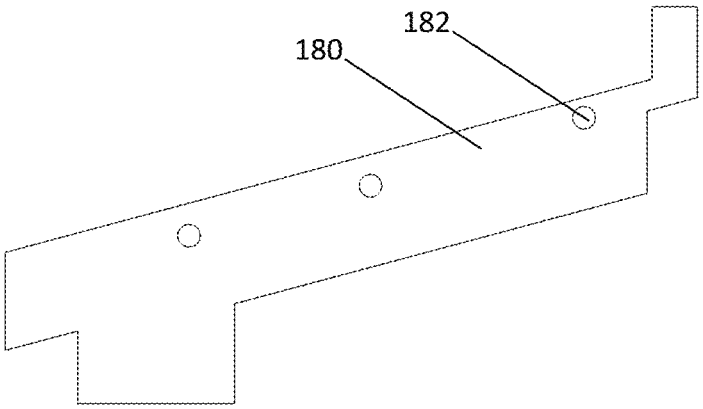
FIG. 27 is a side view of the gasket member shown in FIG. 26.

As most easily seen at FIGS. 3A and 5-8, details of the sill assembly 150 can be more fully viewed. In one aspect, the sill assembly 150 includes a base member 152, an interior trim piece 154, a sill nosing cladding member 156, and a sill cover 158. In one aspect, the base member 152, the side jamb 122, and the end cap 170 form a joint structure. As can be most easily seen in the exploded partial view of FIG. 6, a gasket 180 is also provided that is positioned between the base member 152 and the end cap 170. An exemplary gasket 180 is shown in isolation at FIGS. 26 to 27 where it can be more easily seen that the gasket 180 is provided with apertures 180*a* for allowing fasteners 190 to pass through the end cap 170 and into the base member 152. In some examples, the gasket 180 may be formed from a polymeric or paper-based material In the example shown, the base member 152 is a polymeric material (e.g. PVC) extrusion with snap-fit clip features 152*a* that retain the interior trim piece 154, snap-fit clip features 152*b* that retain the sill nosing cladding member 156, and snap-fit clip features 156*c* that retain the sill cover 158. The base member 152 is also shown as having an upper surface 152*d* and a lower surface 152*e* that extend between first and second ends 152*f*, 152*g* and between a front edge 152*h* and a rear edge 152*i*. Rather than being formed as a completely solid member, the base member 152 is extruded such that hollow cavities 152*j* are formed to reduce weight and cost without sacrificing structural integrity. Between the upper and lower surfaces 152*d*, 152*e*, a plurality of bores or apertures 152*k* are formed for receiving fasteners 190 (e.g. screws) that secure the end caps 170 to the base member 152. The base member 152 can also be provided with a nail fin 152*m* for facilitating securing the window assembly 100 within an opening.

In one aspect, the upper and lower surfaces 152*d*, 152*e* are oriented in a parallel relationship to each other. In one aspect, the upper and lower surfaces 152*d*, 152*e* are oriented at an angle a1 relative to the length of the side jambs 122 and to a pane 110*a* of the sash assembly 110. In one example, the angle a1 is about 15 degrees. The angled orientation of the base member 152 is facilitated by a step 172*c* on the end caps 170 which is also disposed at the angle a1. As configured, the base member 152 is supported by the step 172*c*. As is mentioned elsewhere, the use of a step 172*c* on an end cap 170 avoids the need to perform complex milling steps on the side jambs 122.

Referring to FIGS. 9-14, one of the side jambs 122 and end caps 170 are shown joined together in isolation such that the interaction between the two components can be more easily viewed. As previously mentioned, an exemplary side jamb 122 is shown at FIGS. 15 to 18 while an exemplary end cap 170 is shown in isolation at FIGS. 18 to 25. It is noted that the end cap 170 shown in FIGS. 18 to 25 shows an end cap for one side of the window assembly 100. However, as the end caps 170 are mirror images of each other, the description for the shown end cap 170 is fully applicable for the other end cap 170.

As related previously, the side jamb 122, end cap 170 and base member 152 of the sill assembly 150 form a joint structure. The end caps 170 are configured such that a wood side jamb 122 of the side jamb assembly 120 can be joined to a main body 152 of the sill assembly 150 without requiring special cutting or preparation of the wooden side jamb 122. In typical wood window assemblies, the side jamb is directly connected to and supports the sill assembly main body by a step formed in the side jamb. The formation of the step and other features in a typical wooden side jamb generally requires complicated and time consuming shaping processes (e.g. jump copes, angled dado cuts, tenon cuts, etc.) that are avoided by the disclosed design.

As most easily viewed at FIGS. 15-17, the side jambs 122 each extend between a first end 122*a*, a second end 122*b*, a first side edge 122*c*, a second side edge 122*d*, a first side 122*e*, and a second side 122*f*. The side jambs 122 also include a plurality of bores 122*g* for allowing fasteners 190 extending through the associated end cap 170 to pass through the side jamb 122 before entering and connecting with the base member 152. In one aspect, the bores 122*g* are aligned along a line that is parallel to the angle a1 such that the bores 122*g* align with the apertures or bores 152*k* in the base member 152.

With reference to FIGS. 18 to 25, an exemplary end cap 170 is shown. As mentioned previously, as the right side end cap 170 and left side end cap 170 are mirror images of each other the following discussion applies equally to each end cap 170. In the example presented, each end cap 170 is provided as a unitarily formed main body 172 that is formed from a polymeric material, such as PVC plastic. In one aspect, the main body 172 defines an interior side 172*a* and an exterior side 172*b*. When the side jamb 122 is connected to the end cap 170, the side 122*c* of the side jamb 122 faces the exterior side 172*b* of the end cap 170. The main body 172 is also provided with an end wall 172*c* against which the first end 122*a* of the side jamb 122 rests. The main body is also shown as being provided with sidewall structure 172*d* on the exterior side 172*a* that additionally includes a clip member 172*e*. In one aspect, the sidewall structure 172*d* forms an L-shaped structure having a first side abutting the end 122*d* of the jamb member 122 and a second side abutting the side 122*c* of the side jamb 122. The clip member 172*e* extends into a groove or kerf 122*g* of the side jamb to provide for a more secure connection between the side jamb 122 and the end cap 170.

On the interior side 172*a* of the end cap, a step 172*f* is defined within the main body 172. The step 172*f* defines an angled support surface 172*g* that extends laterally from the interior side 172*a* (i.e. extends orthogonally from the interior face of the main body 172) and extends at the oblique angle a1. Thus, when the base member 152 of the sill assembly 150 rests on the support surface 172*g*, the base member 152 is likewise oriented at the angle a1. The end cap 170 is also provided with a plurality of openings 172*h* through which the fasteners 190 can extend into the bores or apertures 152*k* of the supported base member 152 to secure the end cap 170 to the side jamb 122. The end cap 170 is further shown as including a nail fin flange 172*i* that forms the bottom corner of the nail fin of the window assembly 100. The end cap 170 is also shown as including a sill anchor structure 172*j* defining an aperture 172*k* for receiving a fastener to secure the window assembly 100 within an opening structure.

Figure 28:
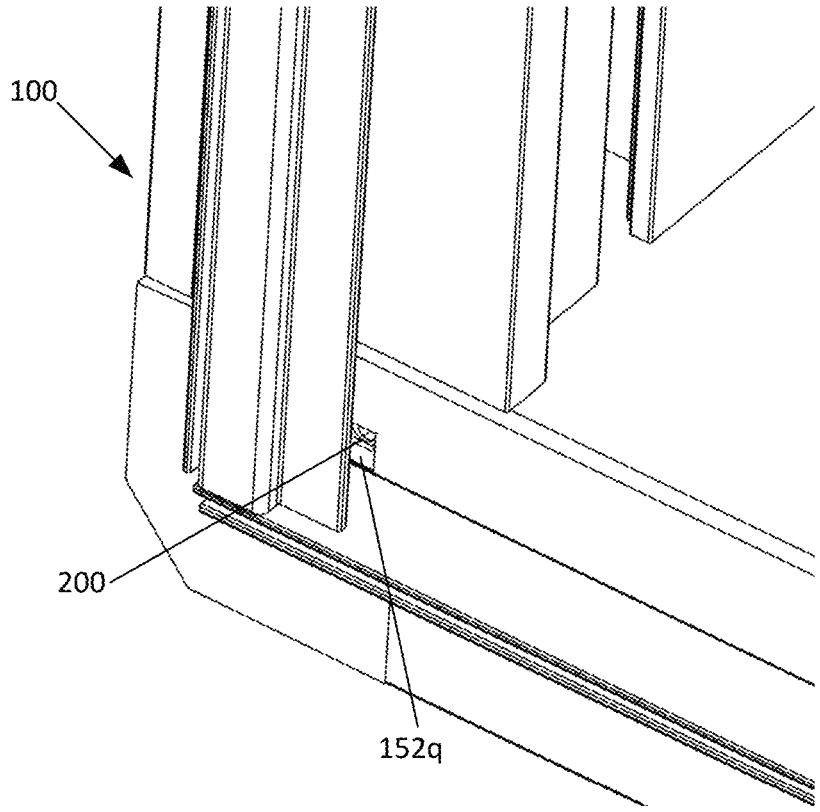
FIG. 28 is an enlarged portion of the window assembly shown in FIG. 1, as indicated at FIG. 28 on FIG. 1.
Figure 29:
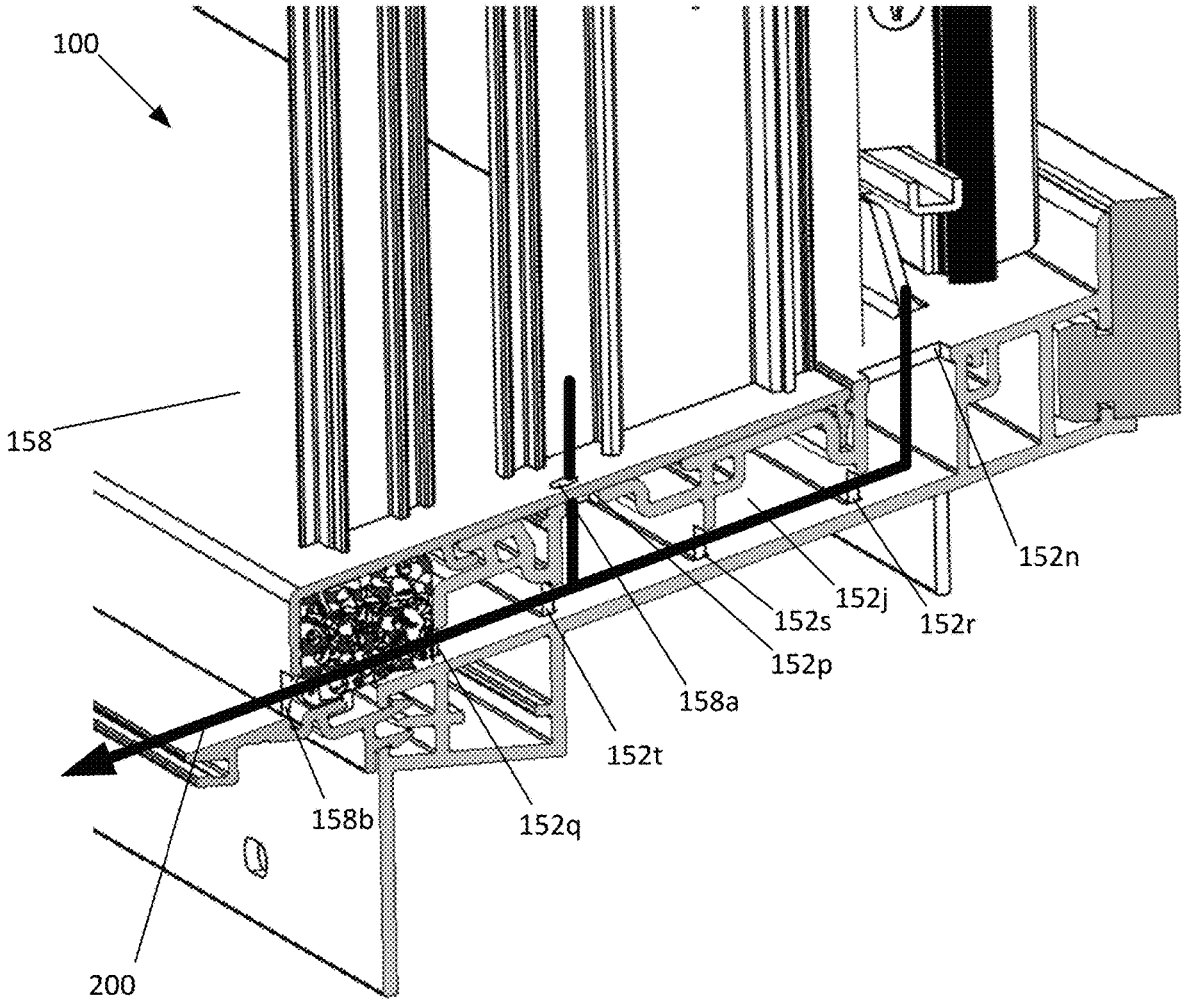
FIG. 29 is a cross-sectional perspective view of the window assembly shown in FIG. 1, taken along the line 29-29 at FIG. 3 shown a drainage pathway within the window assembly.
Figure 30:
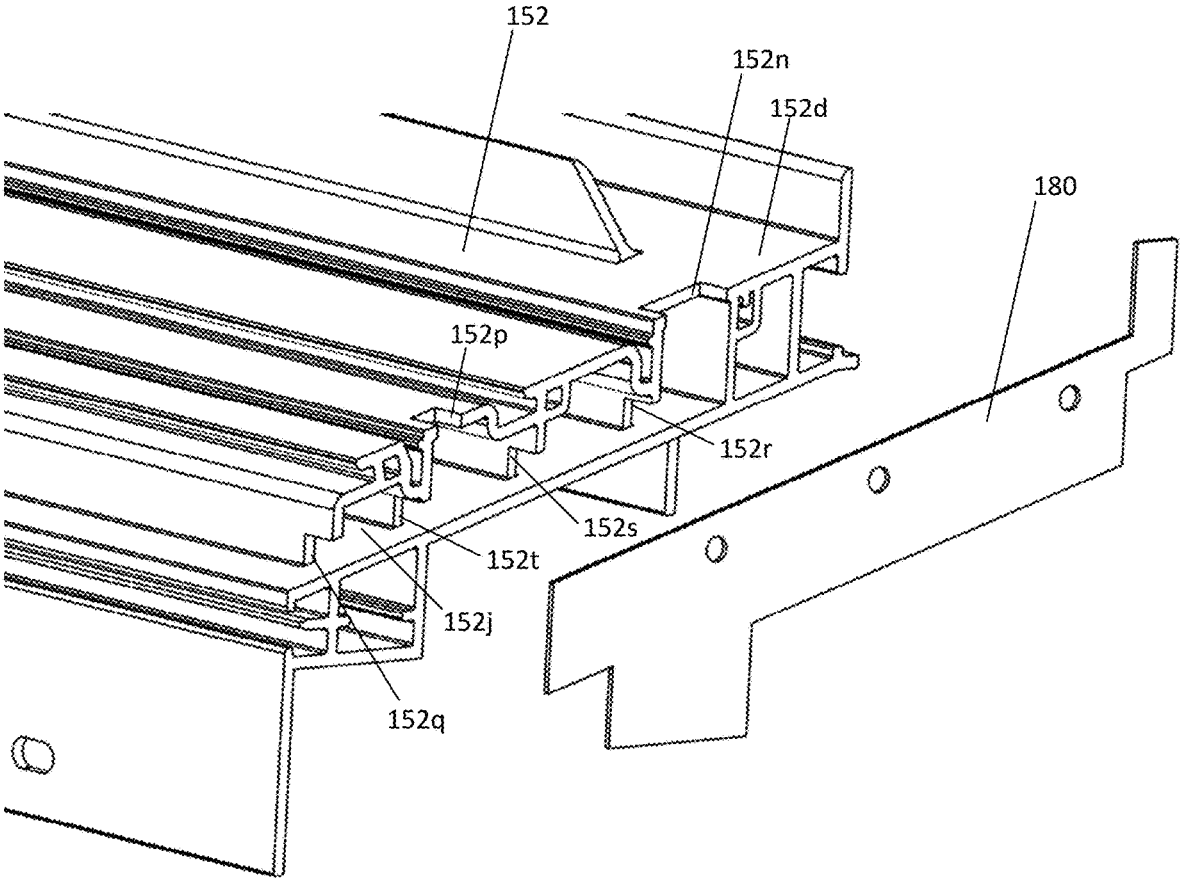
FIG. 30 is a perspective exploded view of an end of a base member and a gasket of the window assembly shown in FIG. 1 that cooperatively form the drainage pathway indicated in FIG. 29.

In one aspect, and as most easily seen at FIGS. 28 to 30, the window assembly 100 can be configured to define a drainage pathway 200 at each side of the window assembly 100. The draining pathways 200 allow for water that contacts the sill assembly 150, either at the sill cover 158 or in the space where the window sash assembly 110 is received within the frame, to be drained to an exterior side of the window assembly 100 through the interior cavities 152*j* of the base member 152. As most easily seen at FIG. 30, the base member 152 and the gasket 180 cooperate to define the drainage pathway 200 which is illustrated at FIG. 29. In one aspect, the base member 152 is provided with a first ingress opening 152*n* and a second ingress opening 152*p* in the upper surface 152*d* of the base member 152. As configured, the first and second ingress openings 152*n*, 152*p* are provided as notches in the ends of the base member 152 that are closed off by the gasket 180. However, the openings 152*n*, 152*p* can be provided spaced inwardly from the ends of the base member 152 such that the openings 152*n*, 152*p* are fully defined within the upper surface 152*d* of the base member 152. As shown, the openings are rectangular in shape, but other shapes are possible, such as openings in the shape of a circle or other geometric shapes. As the sill cover 158 covers the second ingress opening 152*p*, the sill cover 158 is provided with an aperture 158*a* aligned with the second ingress opening 152*p* such that water can be drained from the surface of the sill cover 158 into the interior cavity 152*j* via aperture 158*a* and opening 152*p*.

The base member 152 is shown as further being provided with notched openings 152*r*, 152*s*, 152*t*, 152*q* in the vertical walls located in the interior cavity 152*j* of the base member 152. These notched openings allow water to flow from the ingress openings 152*n*, 152*p* and along bottom surface of the base member towards the front edge 152*h* of the base member. As the base member 152 and sill cover 158 are oriented at the angle a1, this slope will naturally allow for water to drain towards the front edge 152*h* and sill cover 158. From the front edge 152*h*, water flows into an interior space defined by the sill cover 158 and through a notched opening 158*b* in the sill cover 158 to the exterior. As shown, the notched openings 152*r*, 152*s*, 152*t*, 152*q*, 158*b* are open notches closed off by the gasket 180. However, the openings 152*r*, 152*s*, 152*t*, 152*q*, 158*b* can be provided spaced inwardly from the ends of the base member 152 such that the openings 152*r*, 152*s*, 152*t*, 152*q*, 158*b* are fully defined within the vertical walls of the base member 152 or within the sill cover 158. As shown, the openings are rectangular in shape, but other shapes are possible, such as openings in the shape of a circle or other geometric shapes.

As can be most easily seen at FIG. 28, a porous member 202 can be provided in the interior cavity of the sill cover 158 between the notched openings 152*q* and 158*b*. The porous member 202, which could be formed from foam or another material, provides a barrier for the ingress of insects and debris, and also helps to control water percolation during water testing of the window assembly 100.

With regard to the foregoing description, it is to be understood that changes may be made in detail, especially in matters of the construction materials employed and the shape, size and arrangement of the parts without departing from the scope of the present disclosure. It is intended that the specification and depicted aspects be considered exemplary only, with a true scope and spirit of the invention being indicated by the broad meaning of the following claims.

What is claimed is:

1. A window assembly comprising:

a) a pair of side jambs extending between first and second ends;

b) a sill assembly extending between the pair of side jambs proximate the first ends;

c) a head jamb extending between the pair of side jambs proximate the second ends; and d) a pair of oppositely facing end caps operably connecting the pair of side jambs to the sill assembly, wherein each of the pair of end caps includes:

i) a main body defining an interior planar side surface facing an end of the sill assembly and defining a planar step surface;

ii) wherein the planar step surface supports a bottom surface of the sill assembly, wherein the planar step surface extends orthogonally from the interior planar side surface and extends at an oblique angle to a length of the side jamb associated with the end cap such that a top surface of the sill assembly is sloped downwardly towards a front edge of the sill assembly.

2. The window assembly of claim 1, wherein each of the pair of end caps is unitarily formed.

3. The window assembly of claim 1, wherein the pair of side jambs are formed from a wood material.

4. The window assembly of claim 1, wherein the pair of end caps are formed from a polymeric material.

5. The window assembly of claim 1, further including a pair of gaskets, wherein each of the pair of gaskets is located between one of the pair of side jambs and the end cap associated with the side jamb.

6. The window assembly of claim 1, wherein the sill assembly includes a base member formed from a hollow extruded material, the base member including a plurality of openings for allowing water to drain through the interior of the base member.

7. The window assembly of claim 1, wherein the end caps, side jambs, and the sill assembly are secured together by a plurality of fasteners.

8. The window assembly of claim 1, wherein the main body of each of the pair of end caps includes a plurality of pre-formed holes through which the plurality of fasteners extend.

9. The window assembly of claim 1, wherein the sill assembly includes pre-formed holes for receiving the plurality of fasteners.

10. A joint structure of a window assembly, the joint structure comprising:

a) a side jamb;

b) a sill assembly arranged in an orthogonal relationship with the side jamb;

c) an end cap joining the side jamb to the sill assembly, wherein the end cap includes:

i) a main body defining an interior planar side surface facing an end of the sill assembly and defining a planar step surface; and ii) wherein the planar step surface supports a bottom surface of the sill assembly, wherein the planar step surface extends orthogonally from the interior planar side surface and extends at an oblique angle to a length of the side jamb associated with the end cap such that a top surface of the sill assembly is sloped downwardly towards a front edge of the sill assembly.

11. The joint structure of claim 10, wherein the end cap is unitarily formed.

12. The joint structure of claim 10, wherein the side jamb is formed from a wood material, the sill assembly includes a base member formed from a PVC material, and the end cap is formed from a PVC material.

13. The joint structure of claim 10, further including a gasket located between the side jamb and the end cap.

14. The joint structure of claim 10, wherein the end cap, side jamb, and the sill assembly are secured together by a plurality of fasteners.

15. The joint structure of claim 10, wherein the sill assembly includes pre-formed holes for receiving the plurality of fasteners.

* * * * *